US005396876A

United States Patent [19]

Liscio et al.

[11] Patent Number: 5,396,876

[45] Date of Patent: Mar. 14, 1995

[54] APPARATUS AND METHOD FOR PROPELLING A ROLLING HOCKEY BALL

[76] Inventors: Edward P. Liscio, 4200 Lochner Ct., Murrysville, Pa. 15668; Richard A. Riggio, 114 Creekside Ct., Venetia, Pa. 15367

[21] Appl. No.: 8,329

[22] Filed: Jan. 25, 1993

[51] Int. Cl.[6] ..... F41F 7/00

[52] U.S. Cl. ..... 124/6; 124/78; 124/34; 124/51.1; 273/57.2

[58] Field of Search ..... 124/6, 4, 1, 31, 32, 124/34, 78, 45, 48–50, 51.1; 273/57.2, 26 D, 29 A

[56] References Cited

U.S. PATENT DOCUMENTS

| | | | |
|---|---|---|---|
| D. 301,906 | 6/1989 | Coolen | D21/199 |
| 1,196,151 | 8/1916 | Reynolds | 124/6 |
| 1,204,468 | 11/1916 | Marty | 124/6 |
| 1,211,738 | 1/1917 | Marty | 124/1 X |
| 2,566,379 | 9/1951 | Strong | 124/78 X |
| 2,705,945 | 4/1955 | Cavalier | 124/6 |
| 2,955,823 | 10/1960 | Chanko | 124/50 X |
| 3,308,802 | 3/1967 | Applegate | 124/78 |
| 3,574,350 | 4/1971 | May | 273/85 |
| 3,665,910 | 5/1972 | Boni . | |
| 3,709,489 | 1/1973 | Holleran et al. | 273/1 B |
| 3,794,318 | 2/1974 | Holmes . | |
| 3,817,235 | 6/1974 | Blake | 124/6 |
| 3,822,688 | 7/1974 | Mayne | 124/6 |
| 3,838,677 | 10/1974 | Alvares | 124/16 |
| 3,841,630 | 10/1974 | Renna | 273/1 B |
| 3,876,201 | 4/1975 | King | 273/1 B |
| 3,955,815 | 5/1976 | Deschesnes | 273/1 B |
| 4,070,017 | 1/1978 | Lombardi | 273/1 B |
| 4,352,348 | 10/1982 | Griffith | 124/34 X |
| 4,491,320 | 1/1985 | Smith | 273/1 B |
| 4,502,455 | 3/1985 | Stokes | 124/50 |
| 4,596,230 | 6/1986 | Griffith | 124/78 |
| 4,607,842 | 8/1986 | Daoust | 273/1 B |
| 4,653,753 | 3/1987 | Scarry | 273/67 A |
| 4,655,190 | 4/1987 | Harris | 124/78 |
| 4,678,189 | 7/1987 | Koss | 124/50 X |
| 4,705,014 | 11/1987 | Kahelin | 124/1 |
| 4,749,189 | 6/1988 | Frank . | |
| 4,824,107 | 4/1989 | French | 273/1 GC |
| 5,044,350 | 9/1991 | Iwabuchi et al. | 124/78 X |
| 5,046,476 | 9/1991 | Nozato | 124/78 |
| 5,066,010 | 11/1991 | Pingston | 273/26 D |
| 5,125,653 | 6/1992 | Kovács et al. | 273/26 D X |

FOREIGN PATENT DOCUMENTS

| | | | |
|---|---|---|---|
| 2095565 | 10/1982 | United Kingdom | 124/78 |
| 2105203 | 3/1983 | United Kingdom | 273/26 D |

*Primary Examiner*—Dave W. Arola
*Assistant Examiner*—Harry C. Kim
*Attorney, Agent, or Firm*—Staas & Halsey

[57] ABSTRACT

A hockey propulsion device that uses an infrared control unit to control speed of hockey ball ejection as well as starting and stopping. A single DC powered motor rolls a ball along a railed guideway using friction of the ball against a rubber ball propulsion drive wheel on the motor and two rails of the guideway providing three point ball stabilization and rolling ejection. At least two rolling speeds are provided. A two solenoid gate periodically releases balls into a propulsion tube that provides rotational inertia to each ball before it encounters the rotating wheel. Low battery and empty ball sensors indicate when the propulsion device is low on or is out of balls. A swivel ejection guideway allows the ball to be directed from side to side. A detachable hopper allows easy ball gathering and reloading.

13 Claims, 10 Drawing Sheets

APPARATUS AND METHOD FOR PROPELLING A ROLLING HOCKEY BALL

BACKGROUND OF THE INVENTION

1. Field of the Invention

The present invention is directed to a system that propels a practice street hockey ball along the ground toward a player/user and, more particularly, to a system that provides the ball to the player in a smoothly rolling manner at plural speeds remotely selectable by the user.

2. Description of the Related Art

Conventional ball ejection devices used for practice of ball type sports eject the ball into the air toward the user. The ball can be ejected at various speeds with varying air trajectories. Typical such devices include tennis ball and baseball practice machines. Devices that eject objects along the ground, such as hockey puck propulsion devices, slide the ejected object along the ground.

Street hockey uses a hockey ball that rolls along the ground. Generally, the ball is propelled by players along the ground in a smoothly rolling fashion since a smoothly rolling ball is easier to control than a bouncing ball. It is particularly important that passes between players be well controlled, so that the receiving player can field the ball and continue controlled play. Passes are also made at various speeds between the players. As a result, a practice machine for street hockey is needed which will propel a ball in a smoothly rolling fashion and at variable speeds.

SUMMARY OF THE INVENTION

It is an object of the present invention to eject a smoothly rolling hockey ball with at least two speeds toward a practicing player/user.

It is another object of the present invention to provide hockey ball ejection that is remote controllable by the player.

It is also an object of the present invention to provide a self contained hockey ball ejection device that does not need connection to a power supply and is thus portable and positionable on a street, floor, etc. at any location.

It is a further object of the present invention to indicate to the user when the device has a low battery or is out of balls.

It is still another object of the present invention to provide a portable hockey ball propulsion device that has a highly reliable ejection mechanism requiring low maintenance.

It is also an object of the present invention to provide a hockey ball positioning system that is remotely controllable.

It is another object of the present invention to provide a hockey ball ejection system that shoots hockey balls from side to side of the player.

The above objects can be attained by a portable hockey ball propulsion device that uses an infrared control unit to a control starting position of the ball and stopping of hockey ball ejection as well as the speed of ejection. Ejection is accomplished by a single battery powered motor that rolls a ball along a guideway using the friction of the ball against a rubber ball propulsion drive wheel on the motor and two rails of the guideway. The wheel and two rails provide three point ball stabilization and rolling ejection for a smoothly rolling simulated pass. A two solenoid drive gate releases balls from a feed tube into the wheel and guideway. Low battery and empty ball sensors indicate when the propulsion device has a low battery and/or is out of balls. A swiveling ejection guideway allows the ejection of the hockey balls from side to side of the player. A detachable hopper allows easy ball gathering and reloading into the feed tube.

These together with other objects and advantages which will be subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
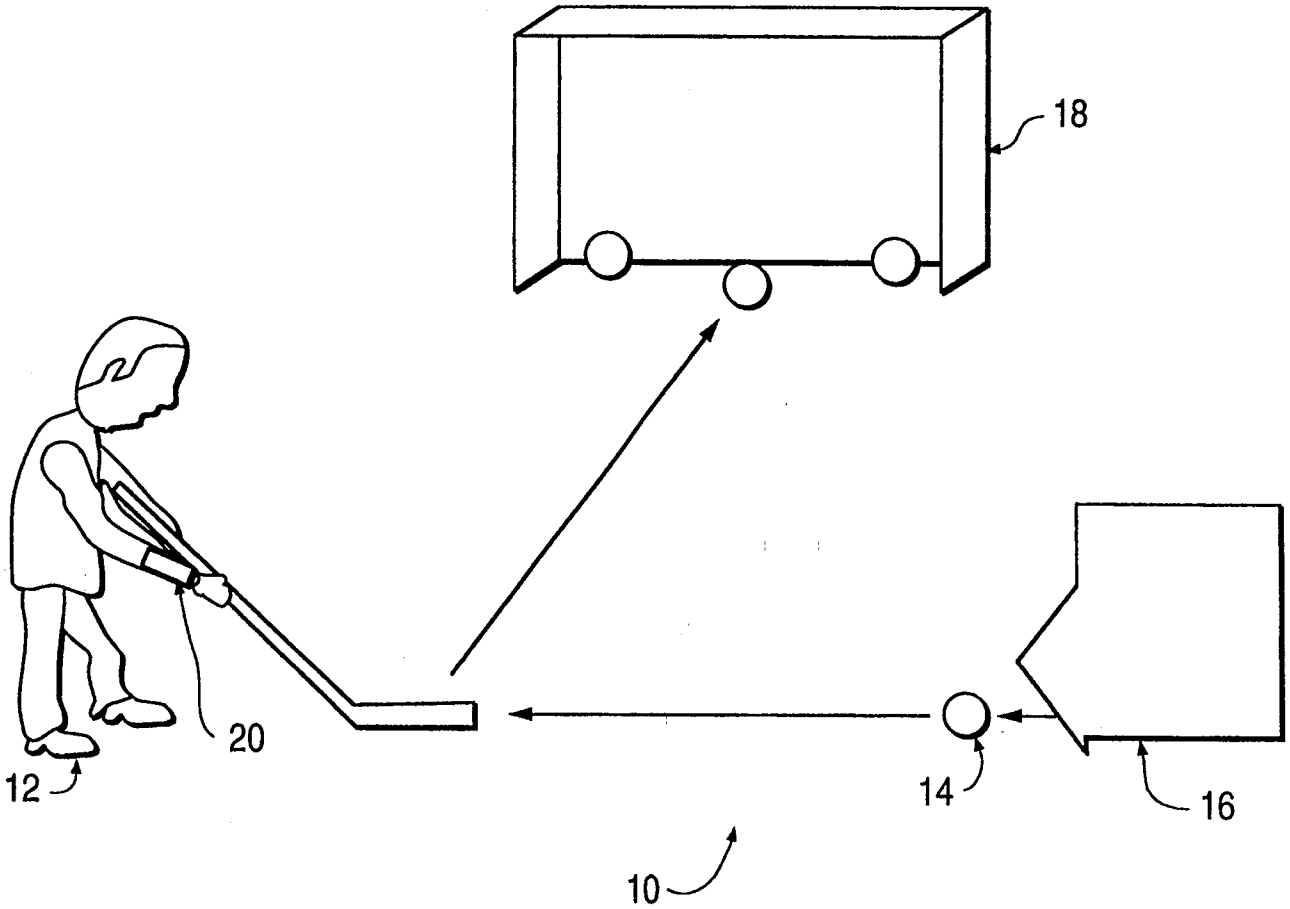
FIG.1 schematically illustrates the system of the present invention.

The present invention is an infrared remote controlled hockey ball (floor, street, etc.) practice system 10, as illustrated in FIG. 1, that enables the player/user 12 to practice shooting a hockey ball 14 for accuracy and speed. This is accomplished through the use of a D.C. propulsion motor which propels the hockey ball 14 to the user 12, at one of two speeds (user selectable), who is standing at a distance within 40 feet of the propulsion unit 16. The ball is propelled in a smoothly rolling manner such that it simulates a pass from another hockey player. This allows the user 12 to then shoot the ball 14 into a net 18 as if another person had made the pass. The propulsion unit 16 is commanded to shoot either a single pass or it is put in continuous mode by the use of an infrared remote control unit transmitter 20 which can be mounted in a glove or helmet, or by a control panel of switches located on the front of the propulsion unit 16. The user also has the capability of aborting the continuous routine at any time desired by simply selecting any of the switches. This allows for the user to have complete control over how many balls the user decides to shoot and when to stop.

The unit 16 houses a series of balls to allow for prolonged operation without having to often reload the machine. When the machine 16 does run out of balls a built in photodetecting sensor triggers audible and visual indications which tell the user to reload the machine. Additional flexibility includes a built-in AC power supply that allows for continuous operation by simply plugging the unit into a standard 120 V, 60 Hz outlet. If operation is desired in an area where this power source does not exist, a built-in rechargeable 12 V battery is provided to allow for 3 to 4 hours of operation before a recharge is necessary. Audible and visual power failure indicators are included to inform the user when the battery needs to be recharged. This prevents the battery from being drained to the point where it will be unable to hold a charge. When the battery is low, the unit can be plugged in for an 8 hour recharge period.

The present invention is divided into three subsystems which include a mechanical system 30, a power system 32 and a control system 34. These three subsystems 30, 32 and 34 interact to produce the following features: AC power system with built-in battery, charger and power on indication; battery low detection circuitry with audible and visual indication; infrared remote control and manual control with data received audible indication; single motor propulsion scheme with three point stabilization; automatic ball feed system for multiple balls with an out-of-balls sensor; dual motor speed option for two distinct pass velocities; and automatic abort sequence when desired by the user.

Figure 2:
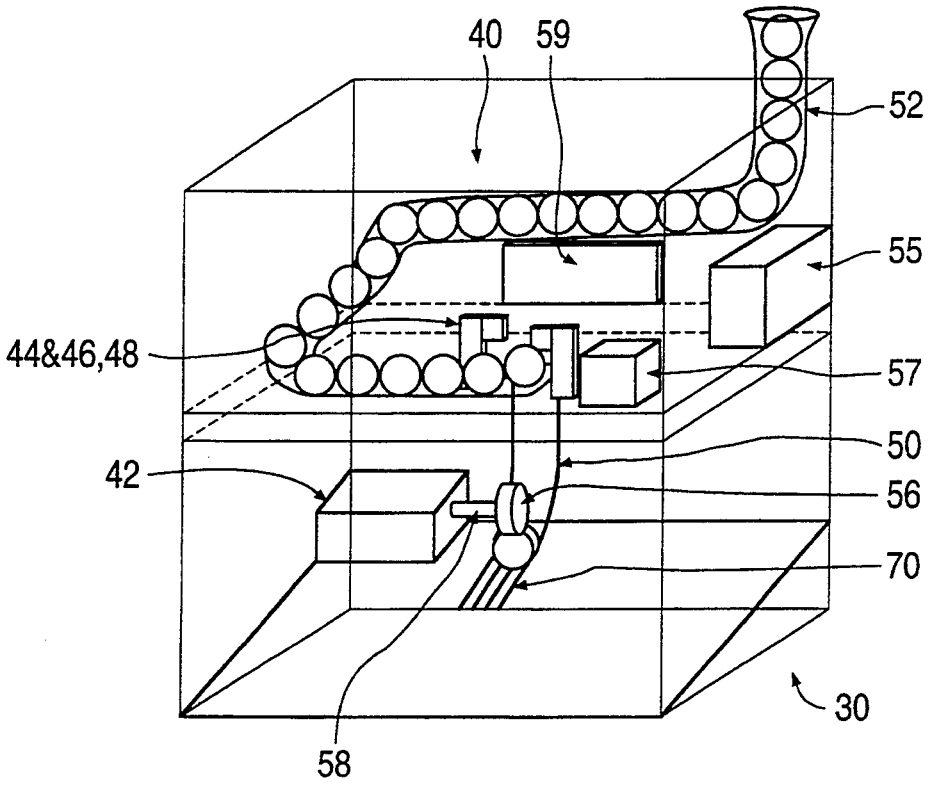
FIG. 2 depicts the mechanical system of the present invention.

The mechanical system 30, shown in FIG. 2 includes a ball feed mechanism 40 and a 2300 RPM, 12 V conventional DC propulsion motor 42 available from Granger as model LM197. A higher RPM motor (such as 4500 RPM) will provide better performance at increased cost. The ball feed system or mechanism 40 utilizes two low power conventional solenoids 44 and 46, available from Guardian Electronics as model 2B-C12 D operating together to lift and drop a gate 48. The solenoids 44 and 46 are placed at opposite ends of the gate 48 (the gate blocks any ball from dropping into a propulsion tube 50), so that a balanced lift of the gate 48 occurs. The balls are contained in a long track or feed tube 52, which is at a slight angle of inclination, and uses gravity to continuously advance balls to the gate 48. When the solenoids 44 and 46 are released (no power applied to the solenoids), the gate 48 blocks the entire column of balls from entering the propulsion tube 50. A microprocessor (to be discussed later), upon receiving a "pass command" retracts the solenoids 44 and 46, using a drive circuit (to be discussed later), for a period of time, such as 0.5 seconds such that only one ball 14 (FIG. 1) is released into the propulsion tube 50. After which time the gate 48 is released, during retraction of the gate 48 a ball train holder (to be discussed later) prevents a second ball from falling into the tube 50. The released ball falls through the propulsion tube 50 which is inclined at an angle or "J" shaped. The inclination or "J" shape starts the ball rolling before the ball encounters the motor 42. The ball is accelerated to the user by the propulsion motor 42 pressing and rolling the ball against a guideway 70.

By using solenoids 44 and 46 that require power to retract (rather than release), the power system (to be discussed later) draws solenoid power for only a brief period of time. This keeps overall power draw low, which extends battery mode playing time. The gate 48 used to release each ball is shaped in a semicircle (to match the outline of the hockey ball, see FIG. 7), such that the friction that prevents the ball from falling into the propulsion tube is applied across a wider area of the ball. In addition, the track or feed tube 52 that advances the balls into the gate 48 has many curves. This is to keep the overall force against the gate 48 as low as possible, all of which allows for a smooth retraction and release of the gate 48.

Also shown in FIG. 2 are the relative positions of a battery 55, a transformer 57 and door mounted electronics 59.

Once a ball is released by the gate 48 it rolls through the angled propulsion tube 50 into a spinning propulsion wheel 56 attached to motor 42. The wheel 56 is spinning in the opposite direction that the ball is rolling. The angled propulsion tube 50 is used to impart to the ball a rotational inertia before the ball engages the spinning wheel 56. This will aid the wheel 56 in propelling the ball and greatly reduces the chances of jamming at the wheel 56. The wheel 56 consists of a solid, disk shaped plastic with an ⅛" thick rubber belt bonded around its perimeter. The rubber belt allows for greater friction when the ball impacts the wheel 56. This increases the velocity of the ball when it is ejected and allows for a small amount of absorption of the inertia of the ball by the wheel 56. The result is a smooth, rolling accurate pass to the user 12 (FIG. 1). The wheel 56 is attached to the propulsion motor 42 by a short direct-coupled aluminum shaft 58 that is light in weight yet very strong. The short shaft 58 reduces any bending effect of the shaft 58 when the ball impacts the wheel 56. This helps prevent warping of the shaft 58 and insures consistent pass velocities. The motor spins at two speeds, producing two distinct pass velocities. More than two speeds are of course possible.

Figure 3:
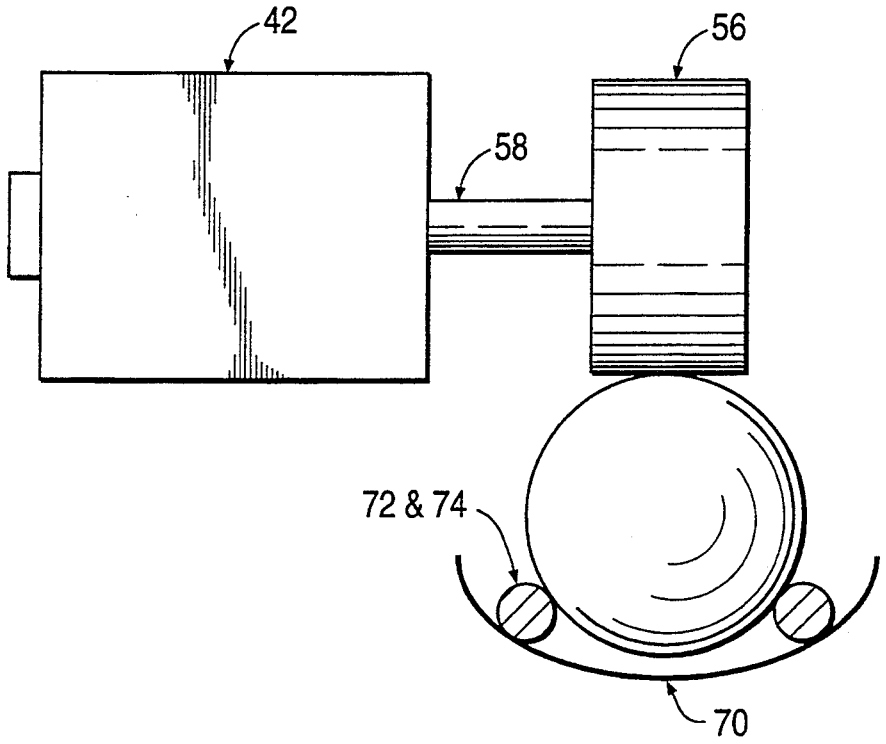
FIGS. 3–5 are front, side and top views of the propulsion mechanism.
Figure 4:
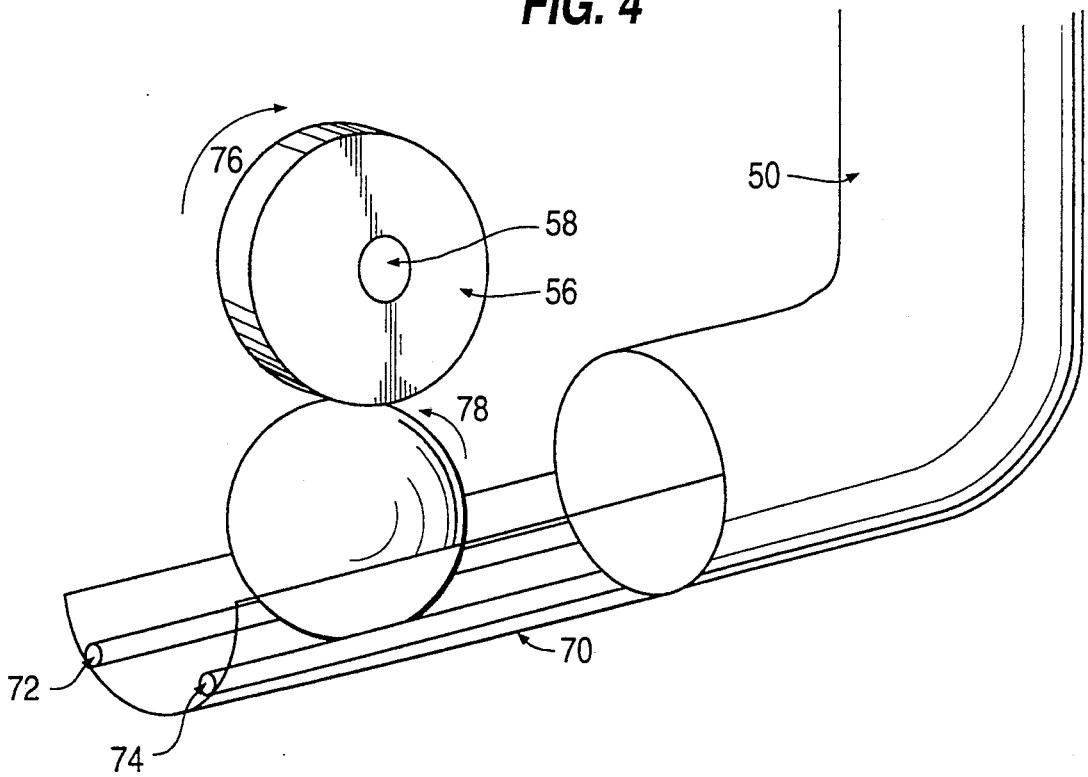
Figure 5:
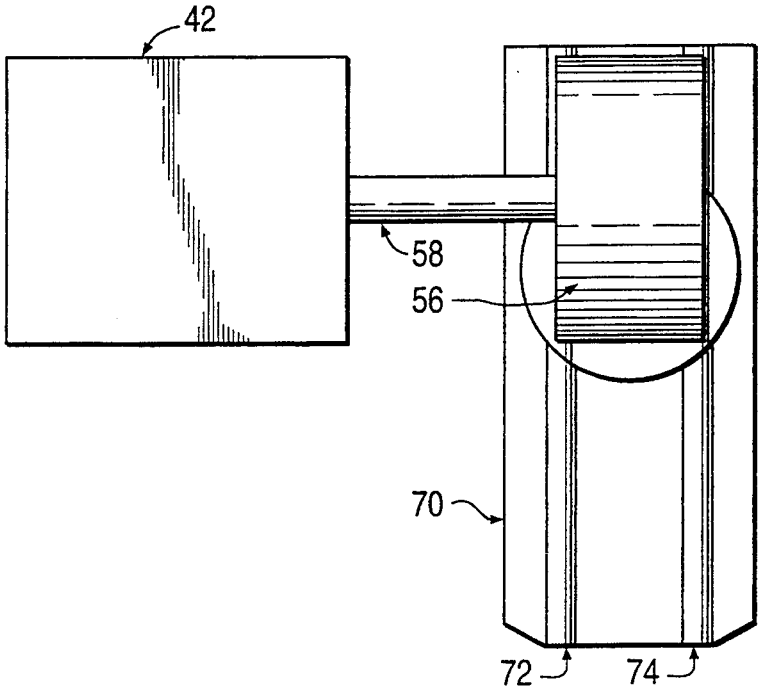
Figure 6:
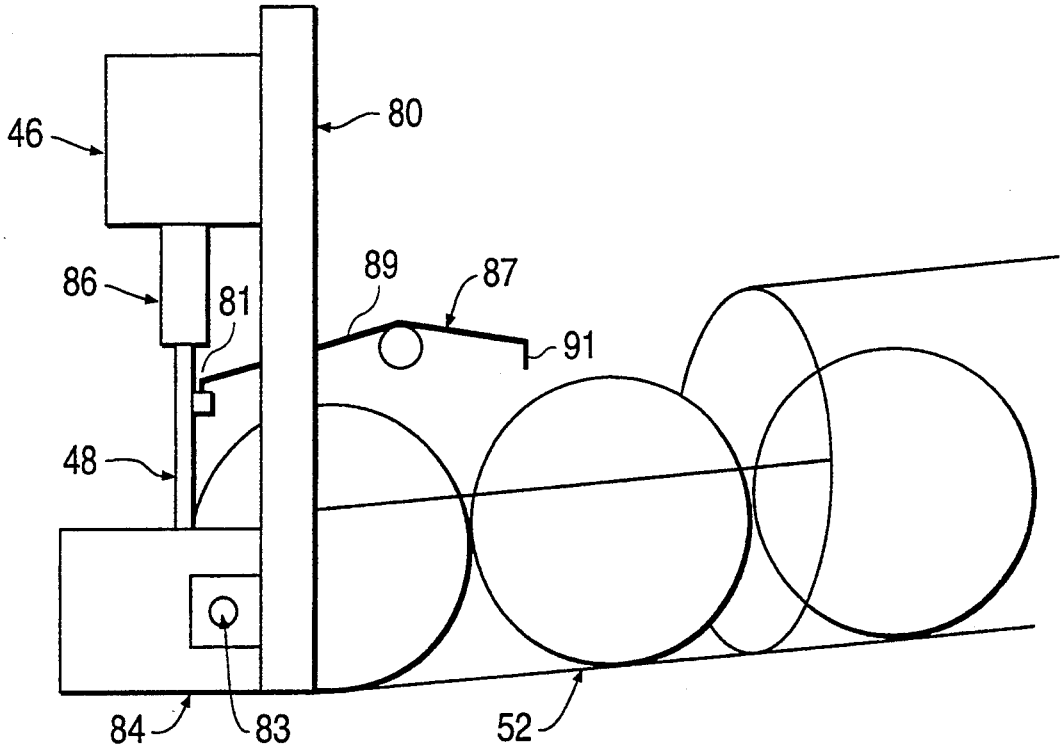
FIGS. 6 and 7 are front and side views of the gate mechanism.
Figure 7:
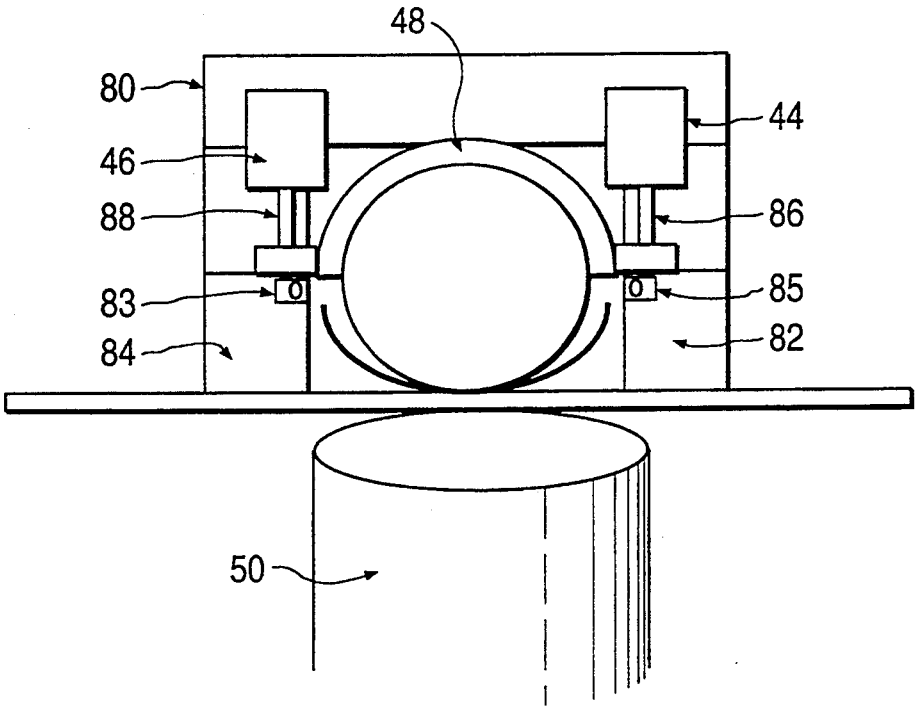

FIGS. 3–5 illustrate the propulsion mechanism. At the end of the propulsion tube 50. The rolling ball contacts the spinning wheel 56 and is pressed between the wheel 56 and a propulsion guideway 70 that includes two rails 72 and 74. The rails 72 and 74 start at the output of tube 50 which requires that the guideway 70 be set lower than the bottom of the tube 50, so that the ball rolls smoothly onto the rails 72 and 74. The wheel 56 rotates in a direction 76 such that rolling friction is applied to the ball by the wheel 56 and rails 72 and 74 to roll the ball along the rails in a rolling direction 78. The three point friction applied by the wheel 56 and rails 72 and 74 stabilizes the rolling direction of the ball and rollingly propels the ball smoothly down the rails 72 and 74 of the guideway 70. The guideway 70 is angled down to the surface on which the unit 16 is sitting. Such that the ball is rolled onto the deck from a height of approximately one inch. Because the guideway 70 extends from the propulsion wheel 56 to the ground it causes the ball to roll with a rolling axis that is parallel to the ground or playing surface plane, thereby rolling the ball onto the playing surface. Although not shown wheels are mounted on the back of the unit 16 allowing the front of the unit to rest on the ground resulting in a minimal drop to the floor from the guideway 70 while at the same time making the unit 16 portable. If wheels are provided to support the entire unit 16, a dropping guideway could be provided that minimizes the drop of the ball once it leaves the guideway. FIGS. 6 and 7 depict the details of the gate 48 and solenoids 44 and 46. The two solenoids 44 and 46 are connected in parallel to the semicircular gate 48. The gate 48 and solenoids 44 and 46 are mounted to an inverted "U" shaped frame 80. The frame 80 includes gate stop blocks 82 and 84 mounted to prevent the gate 48 and attached solenoid retracting bars 86 and 88 from dropping too far. The solenoids 44 and 46 are energized simultaneously when a ball is to be released and lift the gate 48 evenly. The solenoids are activated for approximately 0.5 seconds which will allow a single hockey ball to pass from the tube 52 through the gate 48 and into the propulsion tube 50. An infrared LED 83 and a phototransistor 85, comprising a balls monitor, are used for detecting an out-of-balls condition. A ball train holder 87 is also provided to hold back the next ball from advancing to the gate 48 before the ball at the gate 48 is completely released down the propulsion tube 50. The ball train holder 87 includes a spring hinge joint 81 attached to the gate 48. The hinge joint 81 extends an arm 89 with a tab 92 out over the ball and against the frame 80. The arm 89 is bent in the middle. As the gate 48 rises, the arm 89 is pushed down by the mounting frame 80 causing the tab 91 to be pushed down behind the ball in front of the gate 48 and stop the next ball from rolling forward. When the gate 48 is released and drops the arm 89 moves the tab 91 out of contact with the next ball releasing it.

Figure 8:
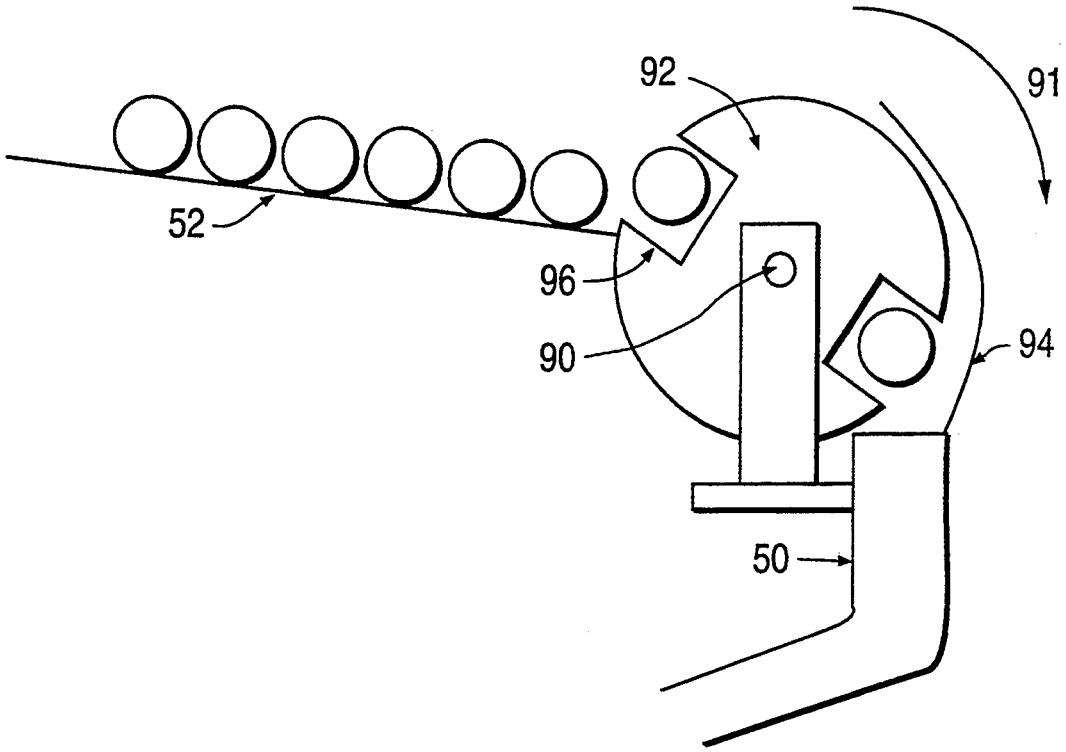
FIG. 8 depicts an alternate ball feed mechanism.

FIG. 8 illustrates an alternate ball release mechanism that includes a stepper motor 90 which rotates a notched gear 92 in a direction 91 and drops balls into the propulsion tube 50. A shield 94 ensures the balls from each notch 96 enter the tube 50.

Figure 9:
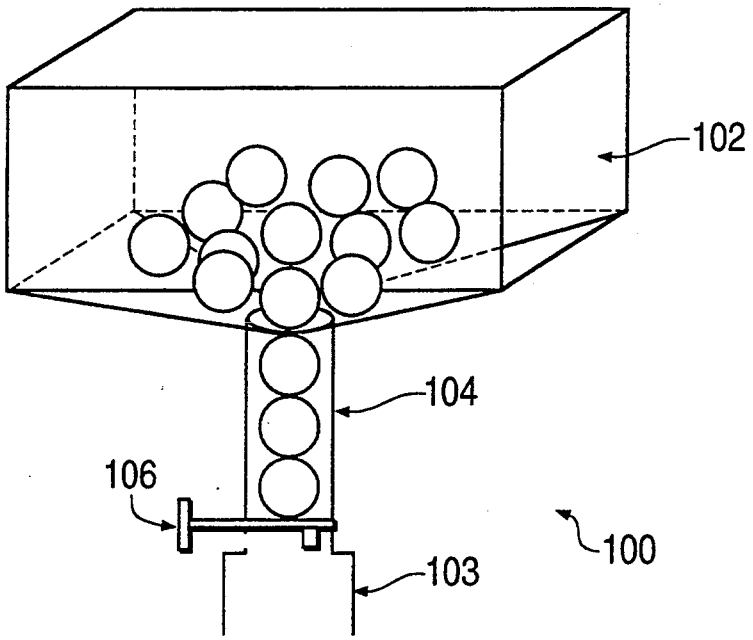
FIG. 9 illustrates a ball hopper.

FIG. 9 illustrates a ball gathering unit 100 that can be used to efficiently gather balls and load them into the system 16. The gathering unit 100 includes a hopper 102 with an exit tube 104 which mates, via a mating receptacle 103, to the ball feed tube 52 in the top of the propulsion unit 16. The exit tube 104 has a spring loaded locking pin 106 that prevents balls from exiting the unit 100. The user pulls back the pin 106 and the balls fall through the tube 104 into the unit 16.

Figure 10:
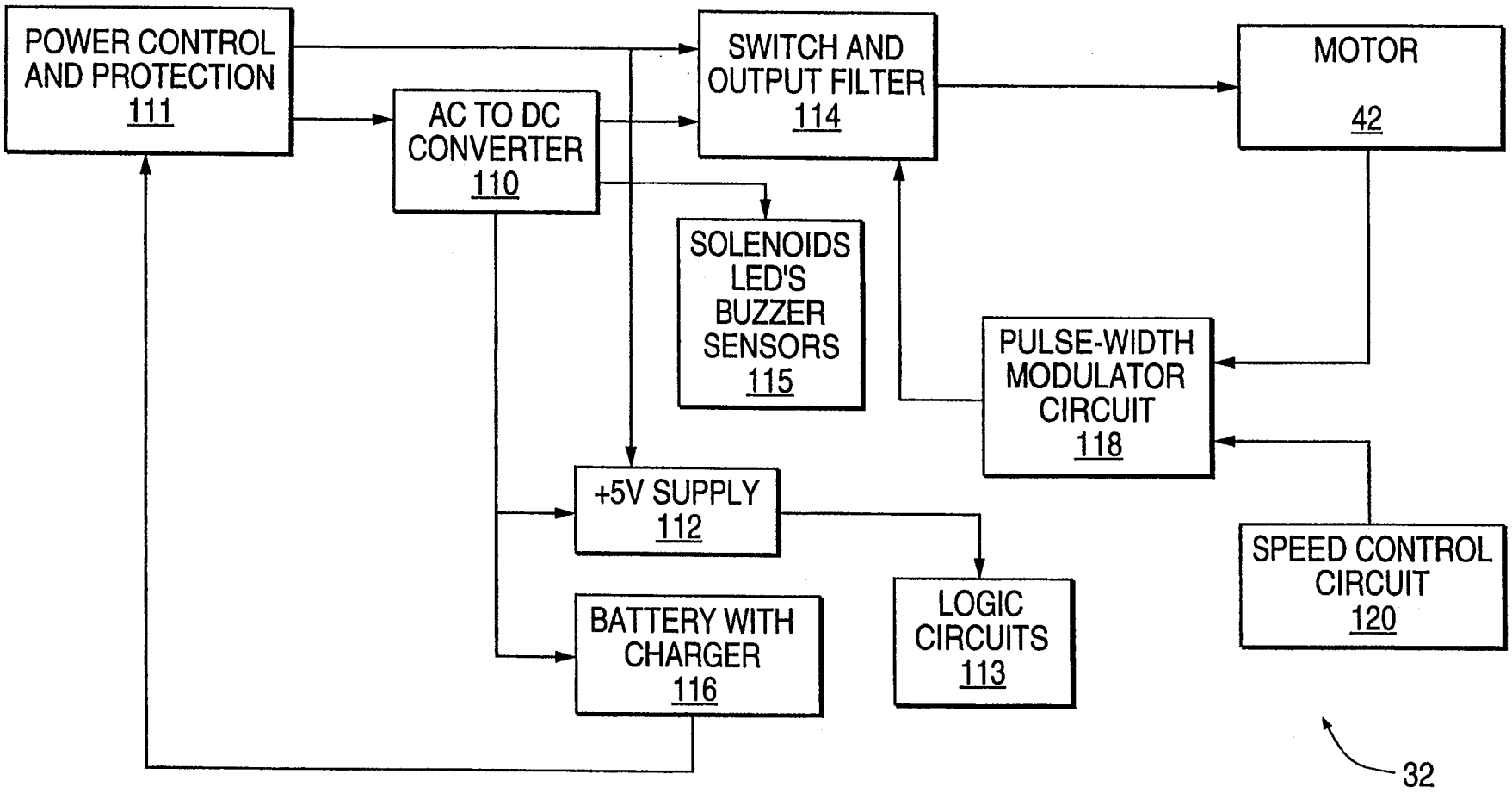
FIG. 10 depicts the power supply system.

The power system 32 illustrated in FIG. 10 includes an AC to DC bulk voltage converter 110, comprising a conventional rectifier and conventional filter capacitor which produces an output which supplies most I/O functions and the power conditioners. Power is supplied to the converter 110 through a power control and protection unit 111 which includes a transformer, power control switches and fuses. The two power conditioners include a 5 V supply 112, used to power all logic circuits 113 and a Pulse-Width Modulated (PWM) high accuracy supply featuring a PWM integrated circuit, such as an SG1524 available from Silicon General to control the voltage (which controls the speed) delivered to the motor 42. The bulk voltage supplies the solenoids, LED's, photodiode sensors and buzzer devices 115 discussed herein. This bulk voltage is also used to charge a battery 116 through a conventional charger provided therewith. When the unit 16 is in battery mode, the battery 116 becomes the bulk voltage source and can supply all system loads for several hours without a recharge. Bulk voltage is considered to be a raw unregulated voltage that is conditioned by other devices (when necessary). The bulk voltage under AC operation can vary between 13 V and 16 V, depending on the power utility company and the load on the system. The bulk voltage under battery operation is generally between 12.2 V and 13 V. The AC bulk voltage is greater than the battery bulk voltage which is good for charging the battery but presents a problem for motor control since a stable bulk voltage is unattainable. The pulse width modulator circuit 118 mentioned above combined with a conventional output filter and switch 114 are used to solve this problem as discussed below.

The motor 42 derives its voltage from the bulk voltage, however, it requires two different voltage levels to produce the two different ball velocities. This is accomplished through the use of a feedback system. When the user selects high speed a speed control circuit 120 signals the modulator circuit 118 to produce maximum motor voltage. The circuit 118 responds with a large on-time duty cycle waveform. Conversely, if the user wants a pass of a slower velocity, the PWM 118 produces a smaller on-time duty cycle waveform slowing the motor 42 and consequently the speed of the ball. This feedback system will also accurately produce the desired motor speed regardless of the level of the bulk voltage. The circuit 118 automatically adjusts the motor voltage by reading and adjusting the voltage to the proper level. The user will not be able to notice any difference in ball velocity when a switch between AC and battery operation occurs.

The logic circuits 113 are supplied with +5 V power by supply 112 which uses a 7806 5 V regulator and available from Motorola. The regulator produces 5 V on its output and can supply up to 1A of current to the 5 V loads regardless of the level of the bulk voltage.

Figure 11:
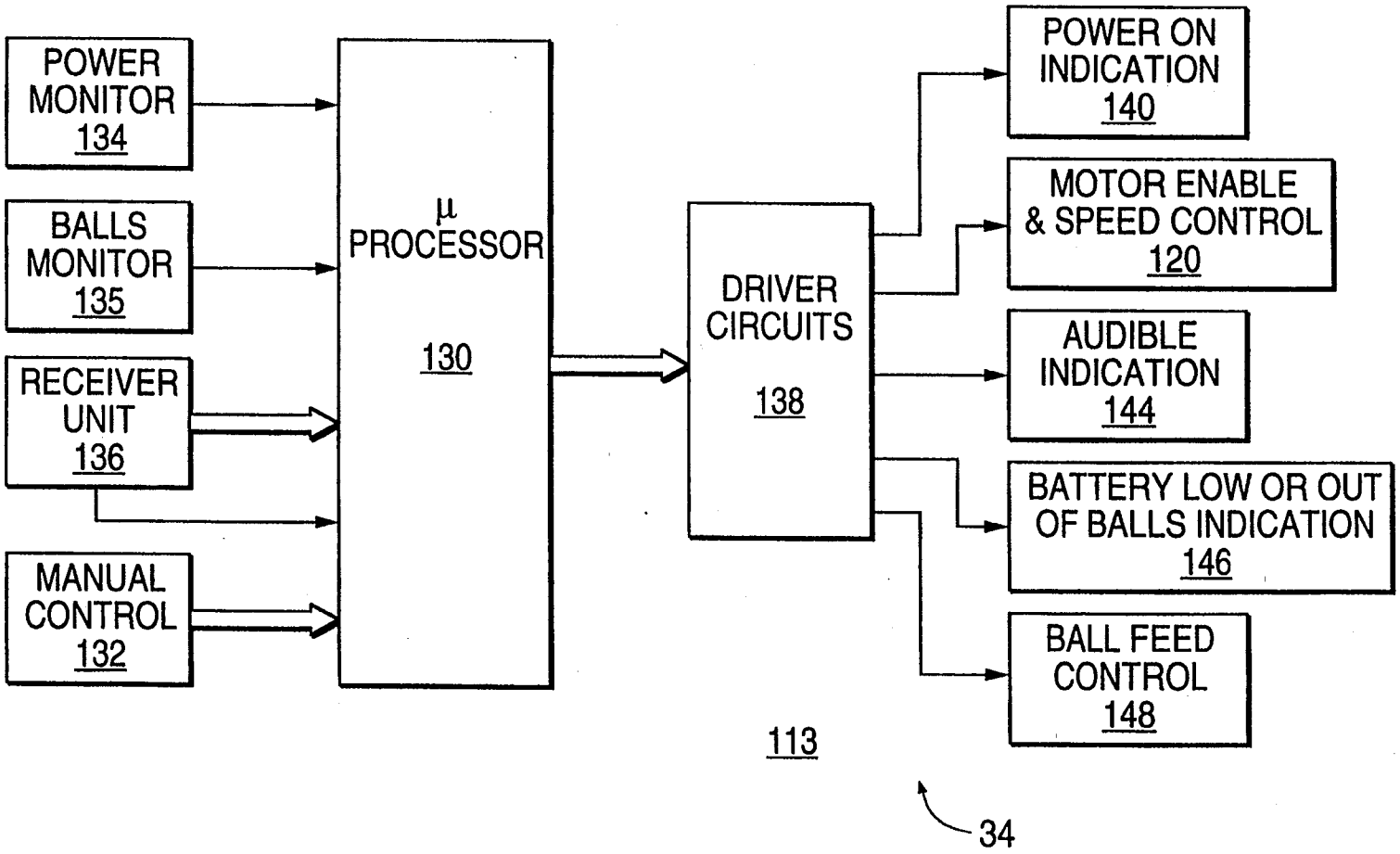
FIG. 11 depicts the electronic control system.

The present invention uses an infrared remote control system to relay commands to a door mounted information processing board 59 of the control system 34, illustrated in FIG. 11, and located inside the unit 16. The heart of the information processing board is an Intel 8748 microcontroller 130 or microprocessor which monitors for a user command (remote or manual) and acts on that command. The microcontroller 130 also acts independently from the user by monitoring for system failures such as "out of balls" or "battery low", which produces audible and/or visual alarms. The microcontroller 130 controls the various I/O circuits which are necessary to provide all of the functions of the system. On the output side of the microprocessor 130 is a driver circuit 138 such as a 7416 driver chip available from Texas Instruments. This driver circuit when enabled by the microprocessor 130 illuminates a power on indication LED 140 and produces motor and speed control outputs to change the bias of the PWM circuit 118 through the speed control circuit 120 which comprises a resistor and transistor that apply the output of the driver circuit to the PWM circuit to change motor speed. The microprocessor 130 also, through circuit 138, illuminates battery low and out of ball indication LED's 146 and drives a buzzer 144. The ball feed control circuit 148 comprises conventional transistors that energize the gate solenoids 44 and 46 and energize the ball detection LED 83 when driven by circuit 138.

Figure 12A:
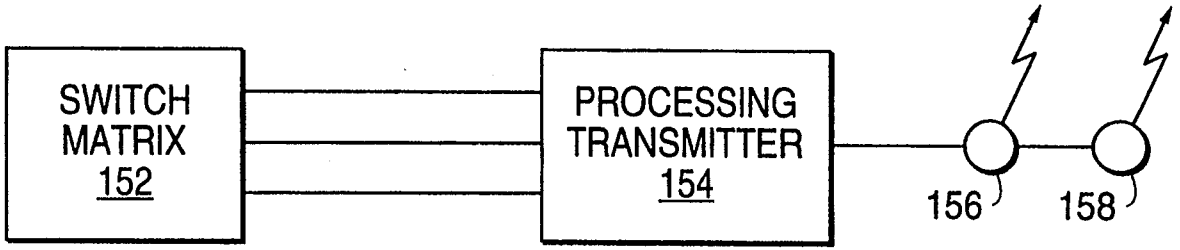
FIG. 12(A) and 12 (B) depict the remote command unit.
Figure 12B:
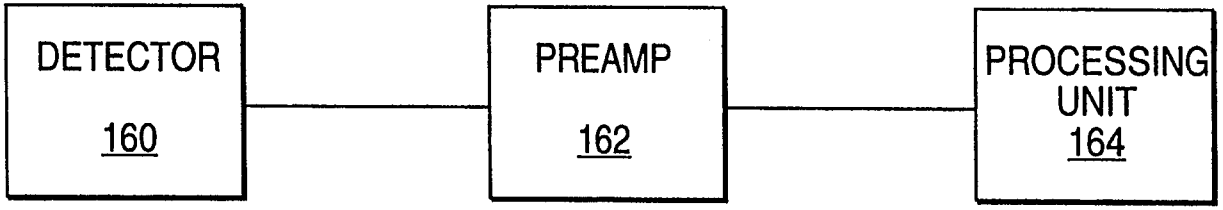

The user controls the unit 16 through either remote or manual switches 132. The transmitter for the infrared remote control system is shown in FIG. 12A. It comprises a switch matrix 152, a processing transmitter 154 available from Plessey as model MV500 and two high output infrared LED's 156 and 158. Two LED's 156 and 158 are used to increase overall range. The transmitter 154 sends infrared data in the form of pulse code modulation to the receiver unit 136 with a range of up to 40 feet. The infrared transmission is detected by an infrared detector 160 of the receiver unit 136 (See FIG. 12B) and amplified by a preamplifier 162, which is an SL486 available from Plessey, and send to an infrared receiving processing unit 164 which is an MV401 available from Plessey. This unit 164 reproduces the transmitted code and presents the data to controller 130 along with a data ready strobe. When the data ready strobe is detected by the controller 130, it reads the data and determines what function the user desires to implement. The user can also execute a function by simply pressing one of the manual switches 132 (located on a front control panel), which are also read by the controller 130.

Once a command has been received by the unit 16, it will be necessary to sequentially drive I/O circuits to produce the desired result. The three main commands are "pass 1 ball", "continuously pass balls", and "change motor speed". The first two commands require a sequence of events to occur. These events are set forth in FIG. 4.

When a "pass ball" command is received by the unit 16 it must first check to see if a ball is in the machine 16. The infrared LED 83 and phototransistor pair comprising the ball monitor 135 are used to accomplish this check (See FIGS. 5 and 6) and are located in front of the gate 48 at the exit of the tube 52. If the infrared LED's beam is interrupted by the ball the controller 130 will read a logic 1 from the phototransistor 85. When there are no balls in the machine the phototransistor produces a logic 0 (due to the infrared LED's beam) which signals the controller 130 the machine is out of balls. The controller 130 will then sound an audible alarm to indicate to the user that the machine requires reloading. If a ball is detected, the controller 130 enables the propulsion motor 42. The controller 130 drives the motor by enabling the PWM 118 through the driver circuit 138 and speed control circuit 120. The motor speed will be dependent upon the operators last choice (the unit 16 preferably powers up in high speed mode). After the motor is enabled, the solenoids 46 and 48 that control ball feed are retracted and then released. The ball release allows one ball to roll into the motor 42, which accelerates the ball toward the user 12. If "continuously pass balls" was the command, the unit will pause momentarily then repeat the process. If the machine runs out of balls during the process the controller 130 will sound an audible alarm and shut off the motor. It should be noted that the motor and solenoid circuits consume the most power and are only running when a command is executing. This saves the battery and allows for longer playing time.

To change the speed of the motor the user simply selects that function (either remote or manual) and the controller 130 stores the current motor speed in memory. Anytime a "pass ball" command is received, the motor will automatically rotate at a speed that corresponds to the users last choice.

The battery low monitoring circuitry 134, including an LM 139 comparator available from Motorola, signals the controller 130 when the battery needs recharging. The controller 130 then drives an audible and a visual alarm and locks out the user from selecting commands. The user can then switch to AC operation to charge the battery and/or continue to use the unit.

Figure 13:
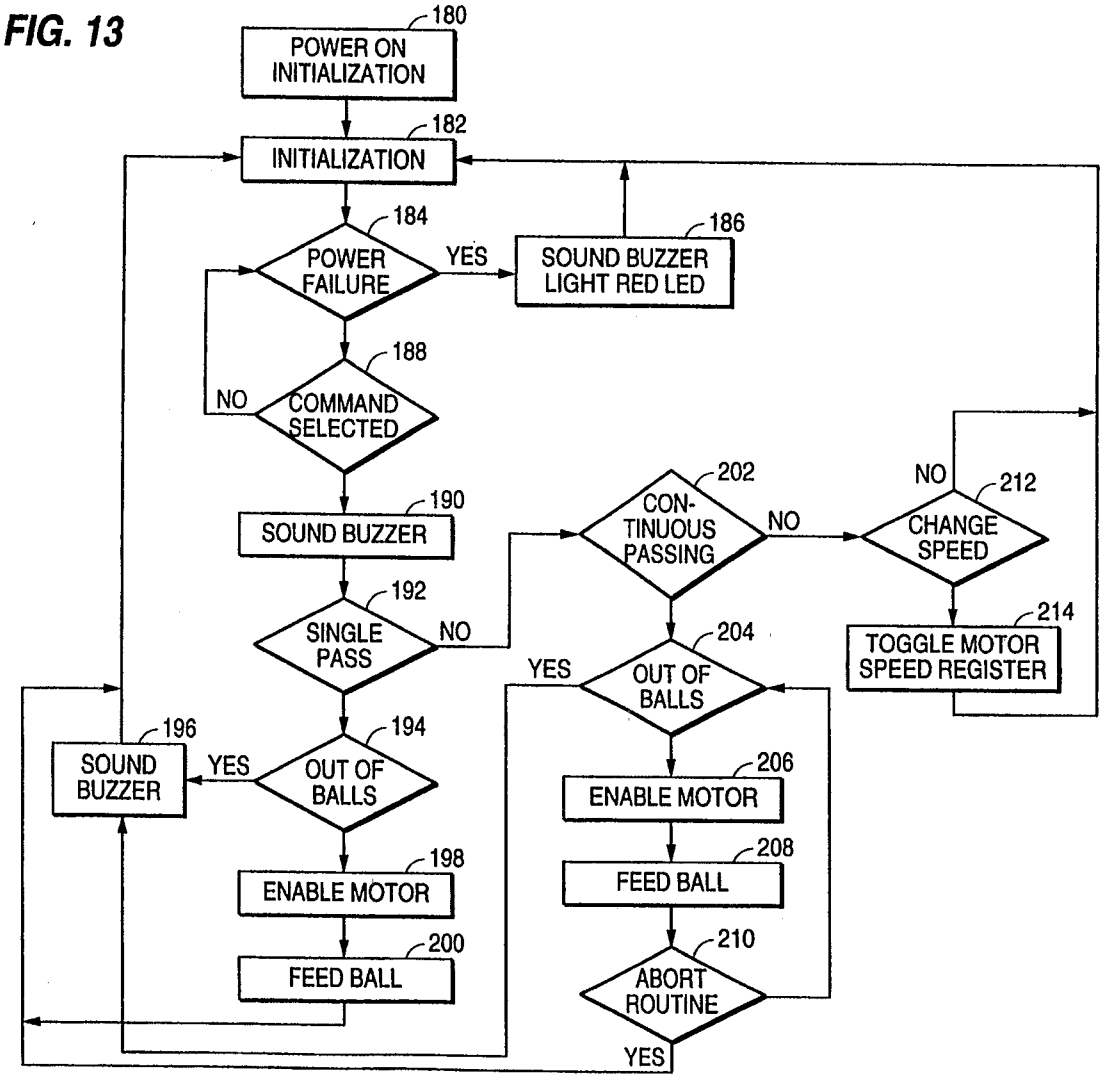
FIG. 13 illustrates the flow of operation of the control system.

FIG. 13 depicts the logical flow or operation flow of the microcontroller 130 of FIG. 11. When the power is turned on the system performs a power on initialization 180 that disables all outputs, checks the level of the bulk voltage and sets the motor speed to high. The first operation in the control loop is to perform an intermediate initialization 182 that stores the previous motor speed and performs the other operations of step 180. The system then determines 184 whether a power failure has occurred. If a power failure has occurred an alarm is announced through the driver circuit 138. A power failure occurs when the bulk voltage drops below 12.2 volts either based on a low battery or poor AC wall voltage. A red LED is turned on and a buzzer sounded. If a power failure occurs the user is locked out. Should the power return to at least 12.2 V the system automatically enables itself. When the battery goes low it can return to full voltage shortly after the load is removed which will result in a series of power failure alarms before a complete lock out occurs. In the next step a determination 188, which includes a scan of the appropriate input bits, is made as to whether a command has been selected. If not, the system loops on steps 184 and 188 until a command is detected. If a command has been selected a buzzer is sounded 190 through the driver circuit 138 to let the user know the command has been received. If the command is a single pass command 192 a determination is made 194 whether the unit 16 is out of balls by energizing the LED 83 and examining the appropriate input bit. If so, a buzzer is sounded 196 through the driver circuit 138. If not out of balls, the motor is started 198 and, after approximately two seconds, a ball is released 200 by lifting the gate 48.

If the command was not a single pass command a determination is made 202 as to whether the command was a continuous ball command. If so a determination is made 204, as previously discussed, as to whether balls exist for propulsion. If so the motor is enabled 206 and a ball is fed 208. The system then checks 210 to see if an abort command has been received and if so returns to the initialization step 182. If not the system, after a pause, loops back to propel another ball.

If the command was not a continuous pass command, the system checks 212 to determine whether the command was a speed change command. If so, the speed control circuit for the motor is toggled 213 to the other of the two speeds.

Figure 14:
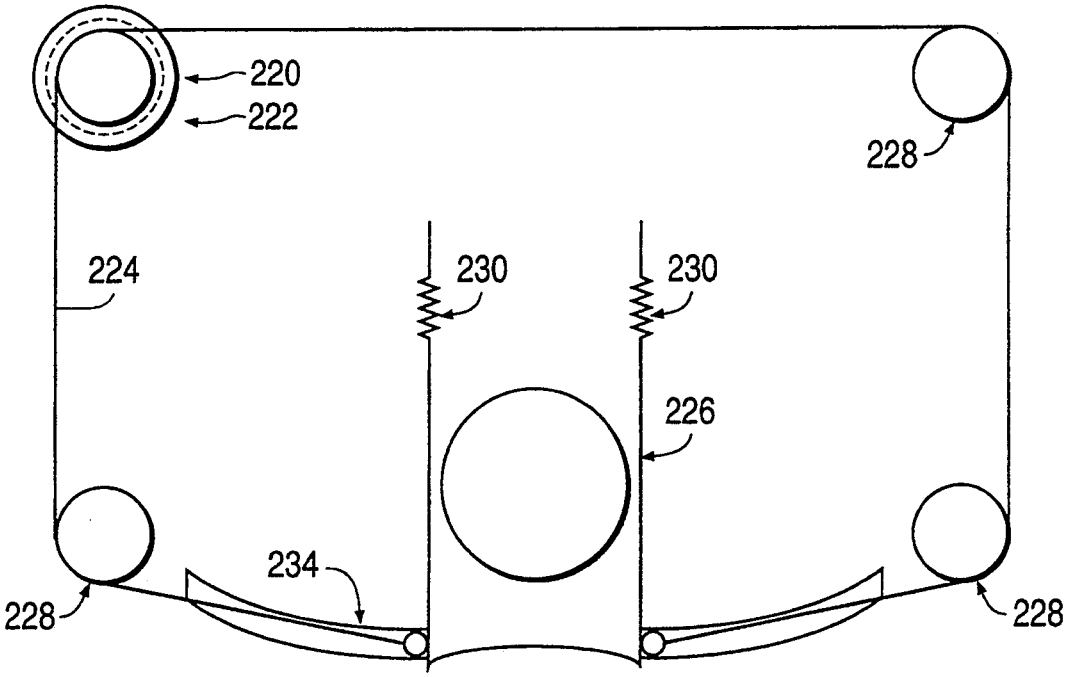
FIG. 14 and 15 illustrate a swiveling guideway.
Figure 15:
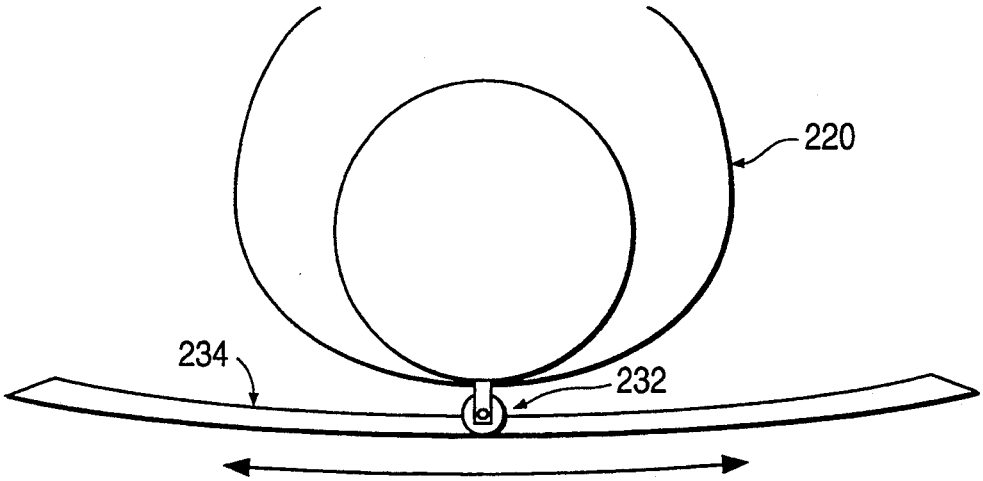

The unit 16 can be upgraded to provide a swiveling ejection guideway which can guide the ball from side to side causing the player to practice approaching and striking a ball not launched directly to the player. Such an upgrade is illustrated in FIGS. 14 and 15. A conventional stepper motor 220 with a bobbin 222 causes a steel cable 224 wound around the bobbin 22 to move a movable embanked guideway 226 back and forth as balls are ejected. The steel cable is attached to the guideway 226 and guided to both sides of the guideway 226 by pulleys 228. The ejection guideway 226 is attached to the propulsion guideway 70 by a flexible plastic joint 230. As the ejection guideway 226 is moved back and forth a roller wheel 232 attached to the bottom of the guideway 226 follows a curved track 234. During operation the guideway 226 is initialized to a known position by rotating the stepper motor 220 between its limits until a photodetecting circuit (not shown), like that for sensing the out of ball condition, detects the roller wheel 232 and the microcontroller 130 senses the detection. Once the guideway 226 is centered, the microcontroller 130 starts a software counter and pulses the stepper motor 220 either in the forward or reverse direction. Each pulse results in a rotational movement of the motor 220 of about seven degrees resulting in a linear movement of the cable 224 which moves the guideway 226. If movement to a particular position is desired, the appropriate number of pulses are provided to the motor 220 and it rotates until that position is reached. Random or fixed positions could be used as the desired position.

The present invention has been described with respect to a system that includes only two ball speeds. Of course plural ball speeds could be provided. In addition other modes than continuous and single ball could also be provided, such as random. If fixed positions for the side to side ball ejection are acceptable solenoids could be used instead of the stepper motor and cable. The system could of course be coin operated if desired.

The many features and advantages of the invention are apparent from the detailed specification and thus it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A hockey ball propulsion apparatus, comprising:
- a ball feed mechanism;
- a ball release gate coupled to said feed mechanism;
- a motor driven wheel receiving a ball from said release gate; and
- a propulsion guideway opposed to said wheel, said wheel and said propulsion guideway propelling the ball onto a hockey ball surface by rolling the ball with a rolling axis along said propulsion guideway, wherein the surface defining a horizontal plane and the rolling axis of the rolling ball parallel to the horizontal plane.

2. An apparatus as recited in claim 1, wherein said motor driven wheel comprises a single wheel rotated by a single motor having at least two ball rolling speeds.

3. An apparatus as recited in claim 2, wherein ball speed is infrared remotely controllable.

4. An apparatus as recited in claim 2, further comprising a pair of solenoids for lifting said gate.

5. An apparatus as recited in claim 1, wherein said guideway includes guide rails and said rails and said wheel providing three contact points with the ball during propelling.

6. An apparatus as recited in claim 1, wherein said ball release gate is infrared remotely controllable.

7. An apparatus as recited in claim 1, further comprising a battery power supply for supplying power to said motor.

8. An apparatus as recited in claim 1, further comprising a propulsion tube between said gate and said wheel and providing a rotational inertia to the ball before the ball reaches said wheel.

9. An apparatus as recited in claim 1, wherein said wheel includes a rubber drive surface.

10. An apparatus as recited in claim 1, further comprising an electronic control unit coupled to said feed mechanism, said gate and said motor.

11. An apparatus as recited in claim 1, further comprising an ejection guideway coupled to said propulsion guideway and directing the ball in predetermined directions.

12. An apparatus as recited in claim 1, wherein said release gate includes a ball train holder holding balls not adjacent to said release gate away from said release gate when said release gate is in an open position.

13. A hockey ball propulsion apparatus, comprising:
- a ball feed tube holding hockey balls;
- a gate confronting said feed tube and blocking and releasing the hockey balls;
- a ball holder attached to said gate and stopping balls not adjacent to said gate from rolling to said gate from said feed tube when said gate is open;
- a pair of solenoids attached to said gate and raising and lowering said gate;
- a propulsion tube confronting said gate and rolling released hockey balls;
- a propulsion guideway including two rails receiving rolling balls from said propulsion tube;
- an ejection direction guideway coupled to the propulsion guideway;
- a stepper motor and cable coupled to said ejection guideway;
- a rotating motor;
- a wheel attached to said motor and having a circumferential rubber rolling surface, the rolling surface pressing the released hockey balls against the two rails and rolling the balls along the two rails of the propulsion guideway onto a hockey ball surface;
- a ball detector coupled to said feed tube and detecting whether balls exist in said feed tube;
- a speed control unit connected to said motor and controlling a speed of motor rotation;
- an AC power supply input;
- an AC to DC power converter connected to said AC power supply input;
- a battery connected to said converter;
- a power supply switch connected to said motor, said battery, said converter and said speed control unit;
- a remote control unit providing remotely controllable commands; and
- a control unit connected to said solenoids, said battery, said converter, said detector, said speed control unit, said remote control unit and said stepper motor, and controlling ball release, ball release direction, and motor speed responsive to said commands, and detecting and indicating a low battery condition and an out-of-balls condition.

* * * * *